US007032940B1

(12) United States Patent
Smith

(10) Patent No.: US 7,032,940 B1
(45) Date of Patent: Apr. 25, 2006

(54) ANIMAL WASTE SCOOPER AND BAGGING SYSTEM

(76) Inventor: Cheryl S. Smith, 6359 Hulen Bend Ter., Fort Worth, TX (US) 76132

( * ) Notice: Subject to any disclaimer, the term of this patent is extended or adjusted under 35 U.S.C. 154(b) by 0 days.

(21) Appl. No.: 11/207,529

(22) Filed: Aug. 22, 2005

(51) Int. Cl.
*A01K 29/00* (2006.01)

(52) U.S. Cl. ..... 294/1.3; 294/55

(58) Field of Classification Search .... 15/257.1–257.9; 294/1.3–1.5, 55, 49
See application file for complete search history.

(56) References Cited

U.S. PATENT DOCUMENTS 3,639,937 A * 2/1972 Sweeney ..... 15/104.8
3,936,087 A * 2/1976 Alexander ..... 294/1.1
4,971,274 A * 11/1990 Mitchell ..... 248/101
5,012,542 A * 5/1991 Lynn ..... 15/1
5,178,426 A * 1/1993 David et al. ..... 294/1.3
5,205,107 A * 4/1993 Herink ..... 53/255
6,953,213 B1 * 10/2005 Yardley et al. ..... 294/1.1

* cited by examiner

*Primary Examiner*—Eileen D. Lillis
*Assistant Examiner*—Esther Onyinyechi Okezie
(74) *Attorney, Agent, or Firm*—Crossley Patent Law; Mark A. Crossley

(57) ABSTRACT

An animal waste scooper and bagging system, comprising a shovel with an open tray, a shovel handle extended from the back border of the shovel, four spaced apart bag hooks in the shovel tray, a plurality of disposable flexible bags, each bag having one open end fitted with a drawstring, four spaced apart eyelets in each bag, the eyelets corresponding to the bag hooks, whereby each bag removably hooks to the eyelets within the shovel tray, a scoop with handle removably snapped onto the shovel handle, disposable gloves removably fitted to the shovel handle.

20 Claims, 3 Drawing Sheets

ANIMAL WASTE SCOOPER AND BAGGING SYSTEM

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Pet refuse collection devices are known in the art and encompass many different designs in efforts to alleviate the problems associated with pet refuse. A properly designed device should provide a sanitary means of collecting and disposing of pet waste. The device should be complete in offering the tools and bagging needed to collect and dispose. Pet waste left uncollected is extremely discourteous as well as unsanitary. Additionally, countless governmental agencies have now imposed fines to halt such practices. The present invention offers a uniquely designed system for solving the problems associated with pet waste collection and disposal.

FIELD OF THE INVENTION

The invention relates to pet waste scooping devices and more specifically to an animal waste scooper and bagging system for the safe and sanitary collection and disposal of pet wastes.

SUMMARY OF THE INVENTION

The general purpose of the animal waste scooper and bagging system, described subsequently in greater detail, is to provide a animal waste scooper and bagging system which has many novel features that result in an improved animal waste scooper and bagging system which is not anticipated, rendered obvious, suggested, or even implied by prior art, either alone or in combination thereof.

To accomplish this, the animal waste scooper and bagging system comprises a shovel with an open tray. The tray is bordered by two triangulated sides which end in a shovel back border. A shovel handle extends from the shovel back border. The shovel handle terminates in a handle loop for ease of gripping. Four spaced apart bag hooks are disposed in the shovel tray. The bag hooks removably accommodate the plurality of disposable flexible bags that are a part of the system. Each bag has one open end fitted with a drawstring. The bag is surrounded on four sides by the flat surround of the bag. The flat surround and the openable bag center are joined by a seam. The seam is preferably hermetic. Four spaced apart eyelets are disposed in each bag flat surround. The eyelets correspond to the bag hooks, whereby each bag removably hooks to the eyelets within the shovel tray. A scoop with handle removably snaps onto the shovel handle. The scoop holder of the shovel handle is flexible to provide for removably holding the scoop. More than one example of scoop holder is offered with the invention. Each example places the scoop holder on opposite sides of the shovel handle. Disposable gloves are removably fitted to the shovel handle via a fastener. Various fasteners are used and include hook and loop, a clip, a hook, and the like.

Thus has been broadly outlined the more important features of the animal waste scooper and bagging system so that the detailed description thereof that follows may be better understood and in order that the present contribution to the art may be better appreciated.

Numerous objects, features and advantages of the animal waste scooper and bagging system will be readily apparent to those of ordinary skill in the art upon reading the following detailed description of presently preferred, but nonetheless illustrative, examples of the animal waste scooper and bagging system when taken in conjunction with the accompanying drawings. In this respect, before explaining the current examples of the animal waste scooper and bagging system in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the animal waste scooper and bagging system. It is therefore important that the claims be regarded as including such equivalent constructions insofar as they do not depart from the spirit and scope of the present invention.

Objects of the animal waste scooper and bagging system, along with various novel features that characterize the invention are particularly pointed out in the claims forming a part of this disclosure. For better understanding of the animal waste scooper and bagging system, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the animal waste scooper and bagging system employing the principles and concepts of the present invention and generally designated by the reference number 10 will be described.

Figure 1:
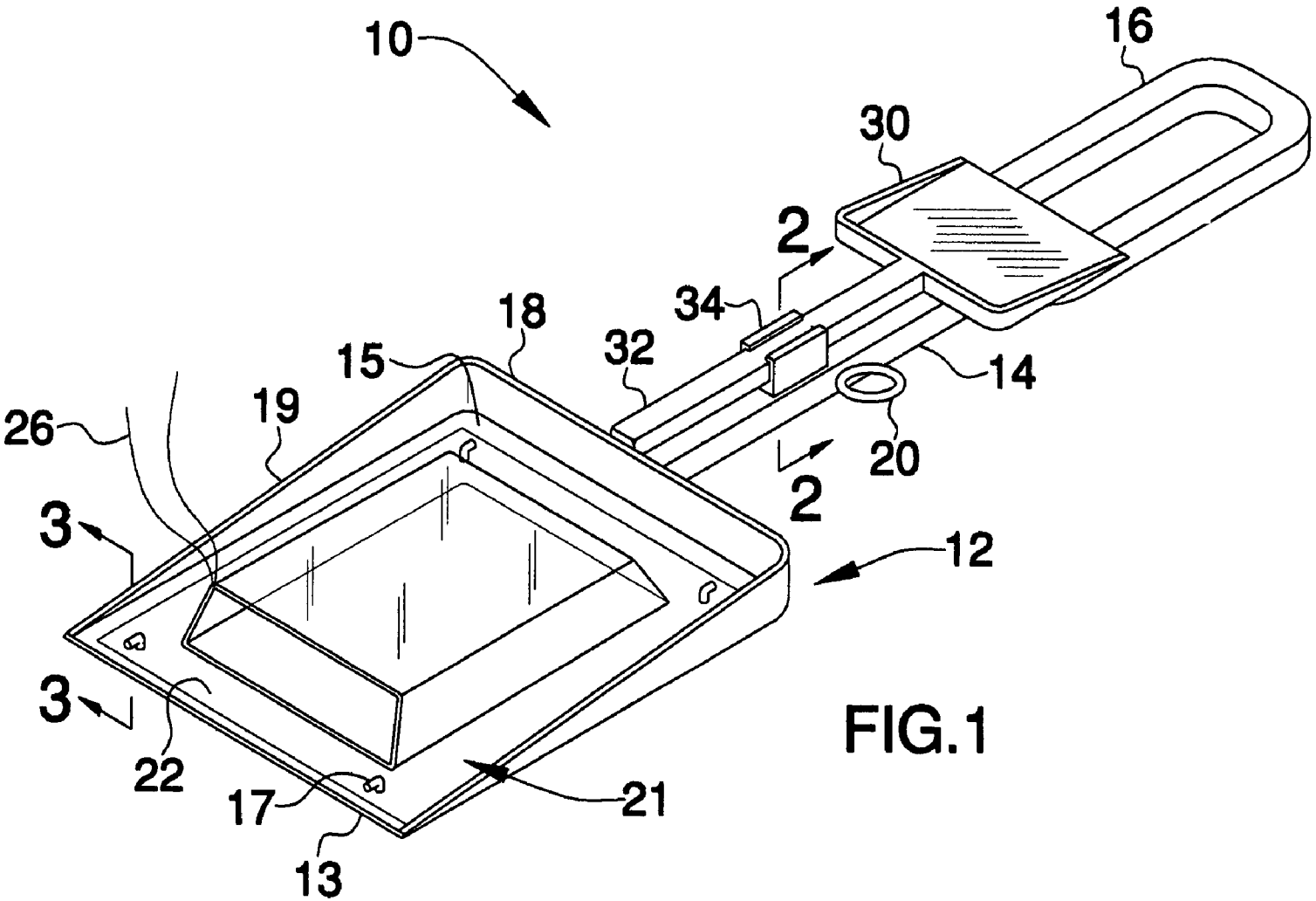
FIG. 1 is a perspective view of the invention.
Figure 4:
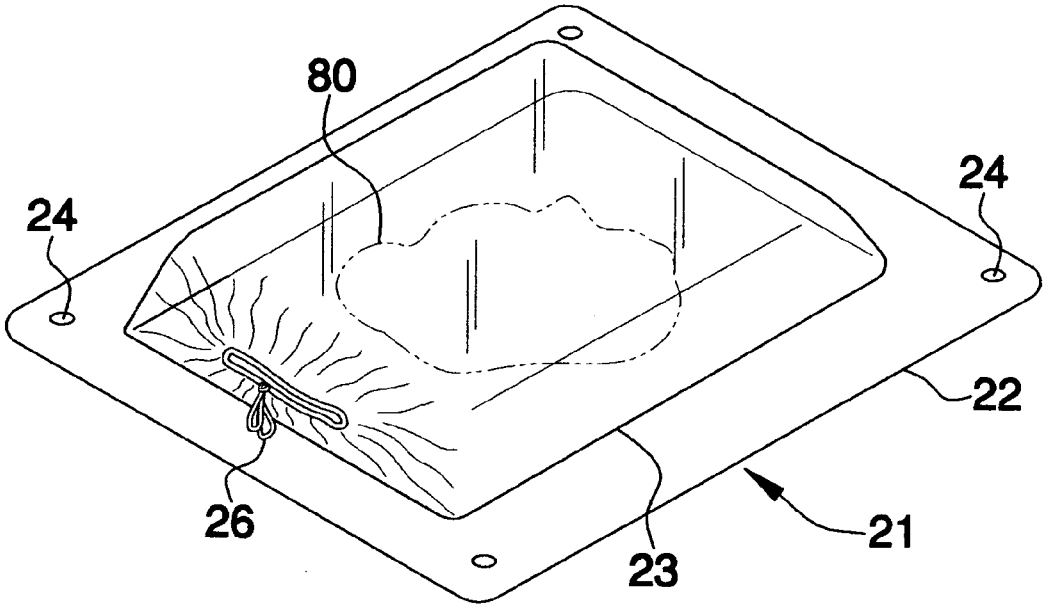
FIG. 4 is a perspective view of a bag of the invention containing animal waste.

Referring to FIG. 1, the invention 10 comprises a shovel 12 with shovel handle 14. The shovel 12 is further comprised of a beveled edge 13 at the bottom of the shovel 12. The triangulated sides 19 upwardly terminate against the back border 18. The open shovel tray 15 is thereby between the sides 19 and the back border 18. The shovel handle 14 extends from the back border 18 of the shovel 12. The shovel handle 14 has a top side and a bottom side. The end of the shovel handle 14 opposite the shovel 12 end forms a handle loop 16. A glove fastener 20 provides for removably securing disposable gloves (not shown) that are provided a a part of the invention 10. A scoop holder 34 is disposed on the top of the shovel handle 14. The scoop holder is flexible and allows for removable insertion of the scoop handle 32 of the scoop 30 via a snap-in movement. The shape of the scoop 30 resembles that of the shovel 12. Another example (not shown) of the invention 10 locates the scoop holder 34 on the bottom of the shovel handle 14. Four spaced apart bag hooks 17 are disposed in the shovel tray 15. A plurality of disposable flexible bags 21 is provided for capturing animal waste 80 (FIG. 4). Each bag 21 has one open end. A flat surround 22 forms the outer perimeter of each bag 21. A bag seam 23 separates the flat surround 22 from the openable portion of the bag 21. A drawstring 26 is disposed at the open end of each bag 21 for closing the bag 21 when it contains waste 80. The flat surround 22 contains four eyelets 24 (FIG. 4) for removably fastening to the hooks 17 of the tray 15 of the shovel 12. The seam 23 prevents waste 80 from entering the flat surround 22. The bag 21 can be selectively placed with the opening facing either toward the beveled edge 13 of the tray 15 or toward the back border 18 of the tray.

Figure 2:
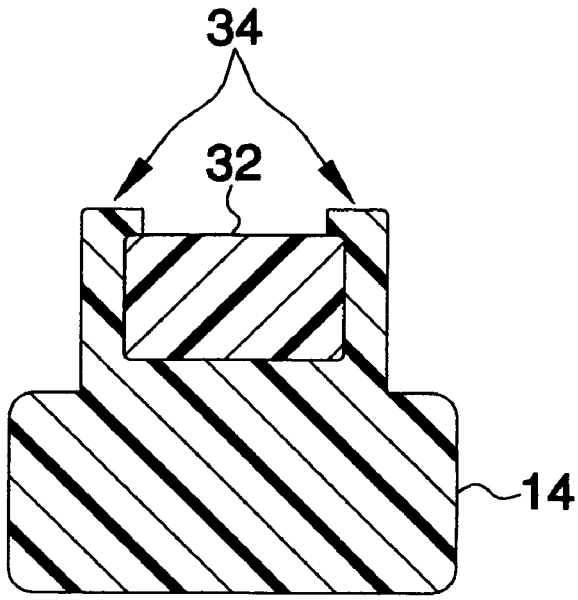
FIG. 2 is a cross sectional view of the scoop holder holding the scoop handle of the invention of FIG. 1, taken along the line 2—2.

Referring to FIG. 2, the snap-in capability of the scoop holder 34 provides for removable insertion of the scoop handle 32 of the scoop 30. In the ideal example of the invention 10, the scoop holder is molded as a part of the shovel handle 14.

Figure 3:
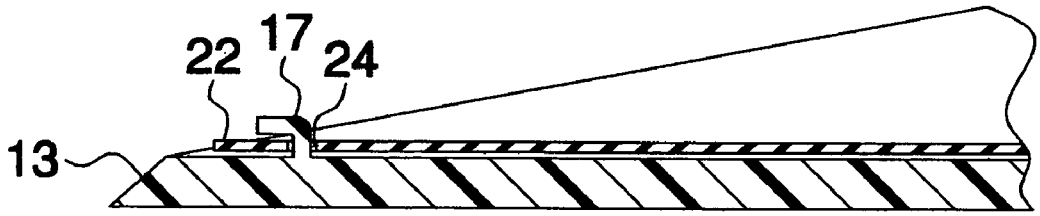
FIG. 3 is a cross sectional view of a bag of the invention removably held by a hook of the tray of the shovel of the invention of FIG. 1, taken along the line 3—3.

Referring to FIG. 3, the beveled edge 13 of the tray 15 of the shovel 12 is proximal to the lower bag hooks 17. The bag eyelets 24 provided for removably securing each flat surround 22 of each bag 21 to the tray 15. Each bag 21 is preferably comprised of four eyelets 24.

Referring to FIG. 4, a bag 21 holds animal waste 80. Drawstring 26 has been tightened and tied to prevent escape of waste 80.

In use, the invention 10 is transported to the desired location where a user installs the eyelets 24 of a bag 21 onto the bag hooks 17. The bag 21 can be installed as a user selects regarding the opening of the bag 21. Typically, the user then removes two gloves from the fastener 20. The scoop 30 is grasped by the scoop handle 32 and removed from the scoop holder 34 of the shovel handle 14. The scoop 30 is used to pick up and place animal waste 80 into the bag 21. Gloves insure the sanitary use of hands by the user in tying the drawstring 26 of the bag 21. The bag 21 is then removed from the hooks 17 and discarded in approved fashion.

With respect to the above description then, it is to be realized that the optimum dimensional relationships for the parts of the animal waste scooper and bagging system, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An animal waste scooper and bagging system, comprising:

a shovel;

a beveled edge at a bottom of the shovel;

a pair of spaced apart triangulated sides of the shovel;

a back border of the shovel into which the triangulated sides upwardly terminate;

an open shovel tray between the sides and the back border;

a shovel handle extended from the back border of the shovel, the shovel handle having a top side and a bottom side;

four spaced apart bag hooks on the shovel tray;

a plurality of disposable flexible bags, each bag having one open end;

four spaced apart eyelets in each bag, the eyelets corresponding to the bag hooks, whereby each bag removably hooks to the eyelets within the shovel tray;

a drawstring at the open end of each bag.

2. The system in claim 1 wherein the shovel handle further comprises a handle loop at an end of the handle opposite the shovel.

3. The system in claim 1 wherein the shovel handle further comprises a snap-in scoop holder;

a scoop for scooping waste;

a handle of the scoop, the handle removably fitted to the snap-in scoop holder.

4. The system in claim 2 wherein the shovel handle further comprises a snap-in scoop holder;

a scoop for scooping waste;

a handle of the scoop, the handle removably fitted to the snap-in scoop holder.

5. The system in claim 3 wherein the scoop handle is on the top side of the shovel handle.

6. The system in claim 3 wherein the scoop handle is on the bottom side of the shovel handle.

7. The system of claim 1 wherein the shovel handle further comprises a fastening means;

a plurality of disposable gloves for removable fastening to the shovel handle fastening means.

8. The system of claim 2 wherein the shovel handle further comprises a fastening means;

a plurality of disposable gloves for removable fastening to the shovel handle fastening means.

9. The system of claim 3 wherein the shovel handle further comprises a fastening means;

a plurality of disposable gloves for removable fastening to the shovel handle fastening means.

10. The system of claim 4 wherein the shovel handle further comprises a fastening means;

a plurality of disposable gloves for removable fastening to the shovel handle fastening means.

11. The system of claim 5 wherein the shovel handle further comprises a fastening means;

a plurality of disposable gloves for removable fastening to the shovel handle fastening means.

12. The system of claim 6 wherein the shovel handle further comprises a fastening means;

a plurality of disposable gloves for removable fastening to the shovel handle fastening means.

13. An animal waste scooper and bagging system, comprising:

a shovel;

a beveled edge at a bottom of the shovel;

a pair of spaced apart triangulated sides of the shovel;

a back border of the shovel into which the triangulated sides upwardly terminate;

an open shovel tray between the sides and the back border;

a shovel handle extended from the back border of the shovel, the shovel handle having a top side and a bottom side;

a loop in the shovel handle;

four spaced apart bag hooks on the shovel tray;

a plurality of disposable flexible bags, each bag having one open end;

a flat surround around the perimeter of each bag;

a seam separating the flat surround from the open bag;

four spaced apart eyelets in the flat surround of each bag, the eyelets corresponding to the bag hooks, whereby each bag removably hooks to the eyelets within the shovel tray;

a drawstring at the open end of each bag.

14. The system in claim 13 wherein the shovel handle further comprises a snap-in scoop holder;

a scoop for scooping waste;

a handle of the scoop, the handle removably fitted to the snap-in scoop holder.

15. The system in claim 13 wherein the shovel handle further comprises a fastening means;

a plurality of disposable gloves for removable fastening to the shovel handle fastening means.

16. The system in claim 14 wherein the shovel handle further comprises a fastening means;

a plurality of disposable gloves for removable fastening to the shovel handle fastening means.

17. The system of claim 13 wherein the seam separating the flat surround from the open bag is hermetic.

18. The system of claim 14 wherein the seam separating the flat surround from the open bag is hermetic.

19. The system of claim 15 wherein the seam separating the flat surround from the open bag is hermetic.

20. The system of claim 16 wherein the seam separating the flat surround from the open bag is hermetic.

* * * * *